United States Patent [19]

Storm

[11] 4,399,339

[45] Aug. 16, 1983

[54] ELECTRICAL CONTACT

[75] Inventor: William F. Storm, Libertyville, Ill.

[73] Assignee: Cherry Electrical Products Corporation, Waukegan, Ill.

[21] Appl. No.: 239,216

[22] Filed: Mar. 2, 1981

[51] Int. Cl.[3] ..... H01H 1/02

[52] U.S. Cl. ..... 200/264; 200/265

[58] Field of Search ..... 200/264–265

[56] References Cited

U.S. PATENT DOCUMENTS

| | | | |
|---|---|---|---|
| 1,571,541 | 7/1924 | Davignon | 200/268 |
| 2,216,654 | 7/1937 | Seubert | 200/263 |
| 2,715,169 | 7/1950 | High | 200/264 |
| 3,177,329 | 10/1961 | Freudiger et al. | 200/268 |
| 3,596,025 | 7/1971 | Talento | 200/264 |
| 3,610,859 | 10/1971 | Schreiner | 200/264 |
| 3,627,963 | 3/1971 | Lindsay | 200/268 |
| 3,641,300 | 8/1971 | Nitz | 200/254 |
| 3,670,129 | 8/1971 | Cherry et al. | 200/263 |
| 3,778,576 | 10/1973 | Anderson et al. | 200/264 |
| 3,818,163 | 6/1974 | Robinson | 200/264 |
| 3,916,132 | 5/1974 | Steinmetz et al. | 200/268 |
| 4,088,480 | 5/1978 | Kim et al. | 200/264 |
| 4,153,755 | 5/1979 | Rothkegel et al. | 200/264 |
| 4,166,201 | 1/1979 | Olander et al. | 200/268 |

FOREIGN PATENT DOCUMENTS

| | | | |
|---|---|---|---|
| 2014639 | 10/1971 | Fed. Rep. of Germany | 200/264 |
| 2723238 | 11/1978 | Fed. Rep. of Germany | 200/264 |
| 2041980 | 9/1980 | United Kingdom | 200/264 |

*Primary Examiner*—Willis Little

*Attorney, Agent, or Firm*—Hume, Clement, Brinks, Willian & Olds, Ltd.

[57] ABSTRACT

In one aspect of the invention, a sintered electrical contact having a contacting surface defining a plurality of voids is disclosed. The voids contain a corrosion retarding fluid which passes onto the contacting surface upon being worn down upon repeated engagement with a conductive element.

7 Claims, 7 Drawing Figures

ELECTRICAL CONTACT

BACKGROUND OF THE INVENTION

This invention relates to an improved electrical contact of the type ordinarily used in switches relays or other such devices. Though electrical contacts of the type described may take any of numerous configurations, they frequently have a contacting surface adapted for repeated engagement by a conductive element to create a "make" or "break" condition.

Because of their relatively good conductivity, and resistance to oxidation and corrosion, many electrical contacts have been made from a class of precious metals defined by gold, silver and platinum. As the cost of these precious metals has increased, however, a bi-metallic contact was developed and utilized. Such a bi-metallic contact was frequently formed by using a precious metal for the mating, contacting surface, and a less expensive metal, such as copper, for the remainder of the contact, particularly the shank portion used to fasten the contact in place.

More recently, the increased costs of precious metals have made it economically undesirable to use precious metals even for the contacting surface of an electrical contact in many applications. However, attempts to fabricate high quality electrical contacts entirely from copper, or other relatively inexpensive high conductive metals, often give rise to many other problems. For example, when exposed to the ambient air, copper and other such metals tend to form oxides relatively rapidly. Being comparatively poor conductors, these oxides tend to act as an insulative layer between the contacting surface of the electrical contact and the conductive element which is adapted to repeatedly engage it.

In an effort to mnimize oxide build-up, a corrosion retarding lubricant has sometimes been applied to the contacting surface of the electrical contact. Though this has been helpful in certain applications, lubricants are not completely effective in all situations. For example, under many operating circumstances the lubricant tends to be wiped away after repeated engagement with the conductive element. Oxide build-up can then continue unimpeded.

It is thus an object of the invention to overcome many of the drawbacks associated with prior art contacts by providing an improved electrical contact which is economical, yet has relatively long life, reliable performance, and ease of assembly. It is also an object of the invention to provide a method for fabricating such an improved electrical contact.

SUMMARY OF THE INVENTION

The foregoing objects, along with many other features and advantages of the invention, are achieved in an electrical contact comprising a contacting surface adapted for repeated engagement with a conductive element. The contacting surface is relatively porous, and is characterized by a plurality of air pockets or voids. In one aspect of the invention the contacting surface is fabricated by sintering conductive particles to form a surface characterized by numerous protuberances which serve as pressure points for ensuring a consistent electrical contact with the conductive element. In another aspect of the invention the voids contain a corrosion retarding and arc quenching lubricant which is adapted to pass from the voids onto the contacting surface as the protuberances on the contacting surface break off or become worn upon repeated engagement by the conductive element. As a result, lubricant can be self-applied to the contacting surface substantially as needed, thereby contributing to arc quenching and the inhibiting of an oxide layer from interrupting the conductive path between the contacting surface and the conductive element.

The improved electrical contact may be manufactured by immersing a contact in a corrosion retarding lubricant, and exposing the contact to pressures sufficiently different from atmospheric pressure so that air in the voids of the porous contact is substantially replaced by the lubricant.

BRIEF DESCRIPTION OF THE DRAWINGS

A preferred embodiment of the invention summarized above is illustrated in the accompanying drawings wherein.

DETAILED DESCRIPTION OF THE PREFERRED EMBODIMENTS

Figure 1:
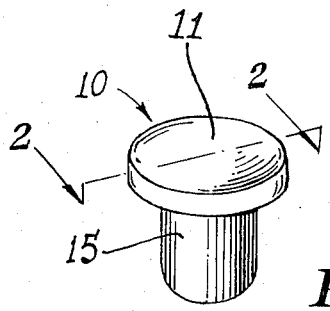
FIG. 1 is a perspective view of one form of the electrical contact of the invention.

Referring now to the figures, and particularly to FIG. 1, there is shown an electrical contact 10 in a preferred form. More particularly, electrical contact 10 has a shank 15 supporting a contacting surface 11, the latter to be explained in greater detail hereinafter.

In this embodiment both shank 15 and contacting surface 11 are fabricated from a conductive metal such as copper. Alternatively, the copper may be alloyed with a hardeneing agent such as indium, cobalt, titanium, etc. In any event, electrical contact 10 is not necessarily made from the class of precious metals defined by gold, silver and platinum, though it may be at the discretion of the artison. Due to the relatively high cost of such precious metals, the manufacture of electrical contact 10 from materials other than precious metals may result in substantial economies in manufacture.

Figure 2:
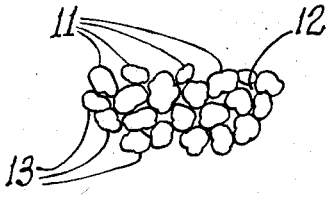
FIG. 2 is a greatly enlarged sectional view of a portion of the electrical contact shown in FIG. 1 taken along lines 2—2 of FIG. 1 and illustrating a contacting surface characterized by voids.

Referring now to FIG. 2, there is shown a schematic illustration, greatly enlarged, or a portion of contact 10 including part of contacting surface 11. Contact 10 is preferably formed by sintering individual particles or grains 13 of copper powder. High points, or protuberances, defined by sintered grains 13 characterized contacting surface 11.

The sintering operation may be accomplished in any suitable manner including: (1) pressing the copper powder so that internal heat is generated in sufficient amounts to cause bonding; (2) firing the powder enough to cause bonding; or (3) a combination of pressing and firing procedures. This sintering process typically results in a porous contact 10 characterized by air pockets or voids identified by reference numerals 12. The size of voids 12, and the porosity of contact 10 may be controlled by grain size, sintering pressure and/or firing temperature. In this particular embodiment grain sizes range from 100 mesh to 325 mesh with a typical sieve analysis yielding the following mixture: 100 mesh - 1%; 100 to 150 mesh - 9.6%; 150 to 200 mesh - 22.4%; 200 to 325 mesh - 25.4%; over 325 meshes - 42.5%. Pressures of 15 to 20 tons per square inch and firing temperatures of 1550° F. to 1620° F., may be employed. This desirably yields a contact 10, 70–80% of whose volume is composed of grains 13, the remaining volume being defined by voids 12. Of course, the fabrication methods and techniques described above, and the parameter's defined in connection therewith, should not be construed as limitative, the invention disclosed herein being defined by the appended claims.

Figure 2A:
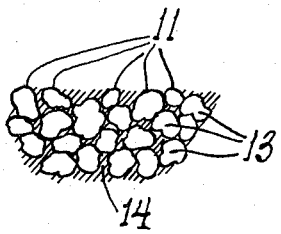
FIG. 2A is a view of the same portion of the electrical contact shown in FIG. 2 depicting lubricant substantially filling the voids in the contacting surface.

Still referring to FIG. 2A, it will be seen tht the contacting surface 11 is not smooth, but is actually composed of peaks, or protuberances, defined by the uppermost layer of grains 13. These protuberances advantageously provide points or areas of high pressure when engaged by a contacting element. This, in turn, ensures a good electrical contact between the contacting element and the contacting surface 11, and represents a substantial improvement over the relatively flat contacting surfaces heretofore used in such contacts.

Turning now to another aspect of the invention depicted in FIG. 2A, voids 12 in contact 10 are shown to be impregnated with a corrosion retarding fluid 14. This fluid may be any appropriate commercially available lubricant such as Cramolin sold by Kaig Laboratories. Fluid 14, which may be maintained in voids 12 with the aid of surface tension, may also cover the uppermost layer of grains 13 including the protuberances defined thereby.

Figure 2B:
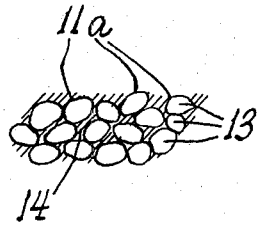
FIG. 2B is a view of the same portion of the electrical contact shown in FIG. 2A after a portion has been worn away upon repeated use.

Repeated engagement of contacting surface 11 of contact 10 by a conductive element, tends to wipe away the fluid 14 that was originally applied to the uppermost layer of grains 13 which form contacting surface 11. Moreover, such repeated engagement tends to gradually break off or wear away the protuberances extending upwardly from original contacting surface 11, thereby defining a new contacting surface **11*a* shown in FIG 2B. As this occurs, however, voids which were heretofore unexposed to the original contacting surface 11 become exposed to the new contacting surface 11*a*. The fluid 14 maintained in these voids is thus free to escape onto contacting surface 11*a*. This results in a self-reapplication of fluid 14 to contacting surface 11*a*. Accordingly, corrosion of contacting surface 11, or contacting surface 11*a***, as the case may be, is substantially retarded.

Figure 3:
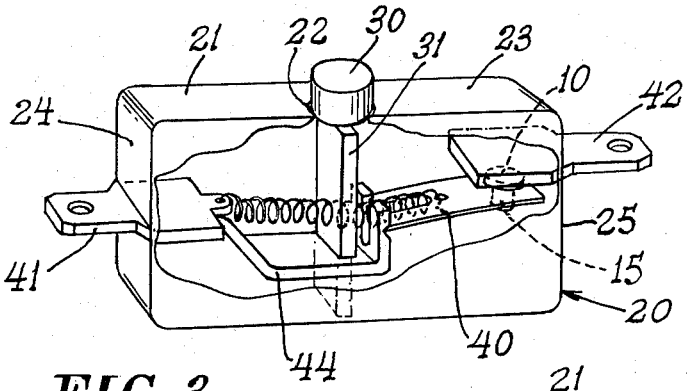
FIG. 3 is a simplified perspective view, partially cut away, of an electrical switch in a "make" position utilizing the contact of FIG. 1.
Figure 4:
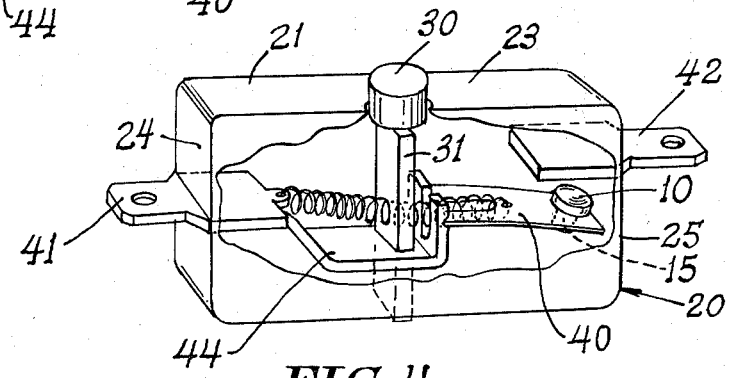
FIG. 4 is a view of the same switch shown in FIG. 4 in a "break" position.

Turning now to FIGS. 3 and 4 there is shown a simplified exemplary electrical switch 20 which forms one of numerous applications for contact 10. FIG. 3 is representative of a "make" condition of switch 20 whereas FIG. 4 is representative of a "break" condition. Switch 20 has a casing 21 comprising a top wall 23 and a pair of side walls 24,25. An aperture 22 in top wall 23 accommodates a push button 30. Push button 30 operates through a spring-biased member 31 against an electrically conductive actuator 40. Mounted at one end of actuator 40 is electrical contact 10.

Disposed in each of side walls 24,25 of switch 20 and extending inside casing 21 is a pair of electrically conductive terminal elements 41,42. Element 41 is in permanent electrical connection with actuator 40 via an electrical connecting strip 44. In the "make" condition of FIG. 3, element 42 engages the contacting surface of contact 10. As a result, element 42 is electrically connected to element 41 through contact 10, actuator 40 and strip 44. In the "break" condition of FIG. 4, however, the contacting surface of contact 10 is moved out of engagement with element 42, thereby interrupting the electrical path between elements 42 and 41.

It should be apparent from FIGS. 3 and 4 that the transition from a "make" to a "break" condition, or vice versa, is accomplished simply by depressing push button 30, thereby moving actuator 40, with attached contact 10, up or down. The contacting surface of contact 10 is thus adapted for repeated engagement with element 42. It is emphasized, however, that such repeated engagement may take place not only by movement of contact 10 as illustrated in this exemplary embodiment, but by movement of element 42, or by any other mechanical operation which accomplishes the desired result.

Figure 5:
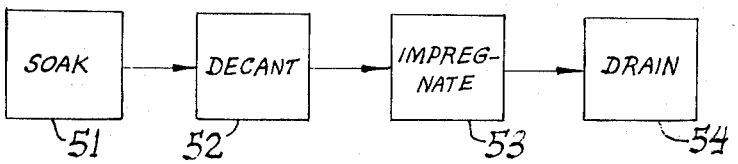
FIG. 5 is a block diagram representing one exemplary method for manufacturing the electrical contact of FIG. 1.

One method for fabricating contact 10 is shown schematically in the block diagram on FIG. 5. In particular one or more (preferably hundreds or thousands) of the sintered contacts described hereinbefore, are placed in a container such as a vacuum jar (not shown). In a soaking operation, represented by block 51, the contacts are cleaned and/or degreased. For example, the contacts may be soaked in tri-ethane, or a similar cleaning or degreasing solvent, at about +180° F. for a period of approximately two hours.

A decanting operation represented by block 52 then proceeds. In this operation the solvent is removed and a pressure of about 25 inches of mercury vacuum is maintained for approximately two hours at a temperature of about +180° F. After decanting comes an impregnating operation, represented by block 53. During impregnation, the pressure of about 25 inches of mercury vacuum is maintained and the corrosion retarding fluid, heated to about +200° F., is introduced. The contacts remain immersed in the lubricant at this pressure for about two hours. Due to the pressure inside the vacuum jar, the fluid is "sucked" through the porous contact 10, into voids 12, thereby substantially replacing the air originally therein.

As exemplified by the draining operation of block 54, the contacts are removed from the vacuum jar after impregnation (and preferably after excess fluid has been decanted), and are placed in a wire basket or the like for draining. Draining is preferably carried out at about room temperature for approximately 24 hours.

The contacts fabricated by the method so described, in addition to being economical and retarding corrosion, achieve numerous other benefits including arc quenching and oxide/sulphide inhibiting. Further these contacts enable switching devices to reliably control lower amperage loads such as relays, solenoids, contactors, motors, and the like without the use of precious metals.

It should be understood that the methods described and the contacts disclosed herein are preferred embodiments. Numerous variations and modifications of the embodiments which do not part from the scope of the invention, may become apparent to those skilled in the art. All such variations and modifications are intended to be covered by the claims.

I claim:

1. An electrical contact comprising:

a contacting surface, adapted for repeated engagement with a conductive element and defined by grains of electrically conductive material;

a plurality of voids defined by said grains; and a corrosion retarding fluid deposited in at least some of said voids, said fluid maitaining its liquid state for all switching operations of said contact, so that the fluid passes from said voids onto said contacting surface as said contacting surface becomes eroded upon repeated engagement by said conductive element.

2. The electrical contact defined in claim 1 wherein said contacting surface is formed by sintering said grains.

3. The electrical contact defined in claim 1 wherein said fluid is disposed in said voids by vacuum impregnation.

4. The electrical contact defined in claim 1 wherein said fluid is maintained in said voids by surface tension.

5. The electrical contact defined in claim 1 wherein said grains are formed from a conductive metal excluding the class of precious metals.

6. The electrical contact defined in claim 1 wherein said contacting surface is defined by grains of copper alloyed with a hardening agent.

7. In a switch having at least two electrically conducting contact elements for making and breaking electrical contact with one another, the improvement of at least one of said contact elements comprising:

a porous matrix of electrically conducting particles, said porous matrix defining voids and having a contact surface for conductively contacting the other contact element, said particles forming protuberances on said surface; and a corrosion retarding fluid disposed in at least some of said voids;

said fluid flowing from voids adjacent to said contact surface for coating the surface with fluid to prevent corrosion of the surface, the protuberances of the surface eroding in response to the making or breaking of conductive contact between the contact elements to open additional voids and to thereby release fluid to maintain the corrosion resistant coating of fluid on the contact surface.

* * * * *

UNITED STATES PATENT AND TRADEMARK OFFICE

CERTIFICATE OF CORRECTION

PATENT NO. : 4,399,339

DATED : August 16, 1983

INVENTOR(S) : William F. Storm

It is certified that error appears in the above-identified patent and that said Letters Patent is hereby corrected as shown below:

In the specification, at column 1, line 36, delete "mnimize" and insert --minimize--;

at column 1, line 65, insert --some of-- after "invention";

at column 2, line 35, delete "in FIG. 4" and insert --in FIG. 3--;

at column 2, line 51, delete "hardeneing" and insert --hardening--;

at column 2, line 60, delete "or" and insert --of--;

at column 2, line 64, delete "characterized" and insert --characterize--;

at column 3, line 5, delete "numerals" and insert --numeral--;

at column 3, line 22, delete "tht" and insert --that--;

at column 4, line 26, delete "on" and insert --of--.

Signed and Sealed this

*Eleventh* Day of *December 1984*

[SEAL]

*Attest:*

GERALD J. MOSSINGHOFF

*Attesting Officer* *Commissioner of Patents and Trademarks*